US008258713B2

(12) United States Patent
Deppe et al.

(10) Patent No.: US 8,258,713 B2
(45) Date of Patent: Sep. 4, 2012

(54) SUPPLYING A SIGNAL TO A LIGHT SOURCE

(75) Inventors: Carsten Deppe, Aachen (DE); Ulrich Boeke, Langerwehe (DE); Chenyang Liu, Shanghai (CN); Peter Luerkens, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 254 days.

(21) Appl. No.: 12/665,126

(22) PCT Filed: Jun. 23, 2008

(86) PCT No.: PCT/IB2008/052471

§ 371 (c)(1),
(2), (4) Date: Dec. 17, 2009

(87) PCT Pub. No.: WO2009/001279

PCT Pub. Date: Dec. 31, 2008

(65) Prior Publication Data

US 2010/0188007 A1 Jul. 29, 2010

(30) Foreign Application Priority Data

Jun. 27, 2007 (EP) ..... 07111158

(51) Int. Cl.
*H05B 37/02* (2006.01)

(52) U.S. Cl. ..... 315/224; 315/225; 315/247

(58) Field of Classification Search ..... 315/209 R, 315/224–226, 247, 291; 323/282
See application file for complete search history.

(56) References Cited

U.S. PATENT DOCUMENTS

| | | | | |
|---|---|---|---|---|
| 5,798,617 | A * | 8/1998 | Moisin | 315/247 |
| 7,573,209 | B2 * | 8/2009 | Ashdown et al. | 315/307 |
| 2005/0218873 | A1 * | 10/2005 | Shuey et al. | 323/282 |
| 2007/0040533 | A1 | 2/2007 | Krein | |
| 2007/0103947 | A1 * | 5/2007 | Taguchi et al. | 363/45 |
| 2008/0018261 | A1 * | 1/2008 | Kastner | 315/192 |
| 2009/0189530 | A1 * | 7/2009 | Ashdown et al. | 315/152 |

OTHER PUBLICATIONS

Garcia et al: "A Simple Single-Switch Single-Stage AC/DC Converter With Fast Output Voltage Regulation"; IEEE Transactions on Power Electronics, vol. 17, No. 2, Mar. 2002, pp. 163-171.

* cited by examiner

*Primary Examiner* — Tung X Le
(74) *Attorney, Agent, or Firm* — Mark L. Beloborodov

(57) ABSTRACT

Supply circuits for supplying voltage and current signals to light sources (6) comprise switches (22, 32, 42, 52) and controllers (21, 31, 41, 51) to control the switches (22, 32, 42, 52) for reducing values of frequency components of harmonic content of power spectra of the light sources (6). By switching one of the voltage and current signals or by switching signals that result in one of the voltage and current signals, the other one of the voltage and current signals can be adjusted. The power spectrum of the light source (6) may be a function of the voltage and current signals. By adjusting one of them, the power spectrum can be adjusted such that values of frequency components of the harmonic content of the power spectrum are reduced. As a result, visible flicker is reduced in the light originating from the light source (6) without the use of energy storage capacitors for reducing this visible flicker.

4 Claims, 13 Drawing Sheets

SUPPLYING A SIGNAL TO A LIGHT SOURCE

FIELD OF THE INVENTION

The invention relates to a supply circuit for supplying a voltage signal and a current signal to a light source, to a device comprising a supply circuit, to a method of supplying a voltage signal and a current signal to a light source, to a control signal for controlling a supply circuit, and to a medium for storing and comprising information for generating a control signal. Examples of such a power supply are switched mode power supplies and other power supplies. Examples of such a device are consumer products and non-consumer products. Examples of such a medium are mechanical memories and non-mechanical memories and carriers such as disks and sticks.

BACKGROUND OF THE INVENTION

US 2007/0040533 discloses in its title an input waveform control in a switching power supply and discloses in its abstract a recognition that a filter size can be reduced substantially as a power factor is permitted to deviate below unity in systematic ways. Specific, computable waveforms permit the use of a minimum filter size, given a desired target power factor. US 2007/0040533 further discloses in its FIG. 8 an output voltage resulting from an input voltage and a predefined input current and further discloses in its paragraph 0043 that, for a converter having a 200 μF output capacitor, this output voltage shows a relatively small 120 Hz ripple. The output capacitor is responsible for reducing this ripple. So, in case the output capacitor has a decreased value, the ripple will get an increased value.

This prior art disclosure is disadvantageous owing to the fact that the ripple in the output voltage is still too large. When using the converter for supplying a light source, this ripple will result in visible flicker. The prior art disclosure is further disadvantageous owing to the fact that the converter uses an electrolytic output capacitor having a relatively large value. Such an electrolytic output capacitor has a relatively short life time, especially at higher temperatures.

SUMMARY OF THE INVENTION

It is an object of the invention to provide a supply circuit for supplying a voltage signal and a current signal to a light source having at least reduced visible flicker (preferably non-visible flicker only), without a relatively large electrolytic output capacitor being required (preferably without any electrolytic output capacitor being required at all).

Further objects of the invention are to provide a device comprising a supply circuit, to provide a method of supplying a voltage signal and a current signal to a light source, to provide a control signal for controlling a supply circuit, and to provide a medium for storing and comprising a control signal, in order to supply a light source having at least reduced visible flicker (preferably non-visible flicker only), without a relatively large electrolytic output capacitor being required (preferably without any electrolytic output capacitor being required at all).

A first aspect of the invention provides a supply circuit for supplying a voltage signal and a current signal to a light source, the supply circuit comprising at least one switch and a controller for controlling the at least one switch for reducing a value of at least one frequency component of a harmonic content of a power spectrum of the light source.

The at least one switch for example switches one of the voltage and current signals or for example switches a signal that results in one of the voltage and current signals. This way, the other one of the voltage and current signals can be adjusted. The power spectrum of the light source is for example a function of (a product of) the voltage and current signals. By adjusting one of them, the power spectrum can be adjusted in such a way that a value of at least one frequency component of the harmonic content of the power spectrum can be reduced. As a result, visible flicker can be reduced.

Visible flicker may be flicker that is visible directly and/or may be flicker that is visible indirectly, for example in the form of stroboscopic effects for moving objects.

The light source is fed with the voltage signal, such as for example an AC voltage signal, and/or with the current signal, such as for example an AC current signal. The light source may be AC type or DC type. For example gas discharge lamps are often, but not always, AC driven. For example Light Emitting Diodes or LEDs and Organic Light Emitting Diodes or OLEDs are DC type.

According to an embodiment, a supply circuit is defined by the at least one frequency component of the harmonic content comprising at least a first frequency component at a frequency equal to twice a basis frequency of at least one of a further voltage signal and a further current signal originating from an AC source.

The first frequency component of the harmonic content of the power spectrum for example has a frequency of 100 Hz (2×50 Hz, Europe) or 120 Hz (2×60 Hz, USA).

According to an embodiment, a supply circuit is defined by reducing visible flicker in the light originating from the light source without using an energy storage capacitor for reducing this visible flicker.

According to an embodiment, a supply circuit is defined by the power spectrum being a function of the voltage signal and the current signal, and the at least one switch switching the voltage signal for controlling the current signal. The energy storage capacitor that should not be used and that should be avoided is for example an electrolytic capacitor.

According to an embodiment, a supply circuit is defined by the controller comprising an arrangement for generating a control signal for the at least one switch.

Such an arrangement may be a memory or a drive. When the light source is known, it is not necessary to measure a signal in the supply circuit, and the control signal may be defined in advance.

According to an embodiment, a supply circuit is defined by the controller comprising a converter for converting a measured signal into a control signal for the at least one switch.

Such a converter may be (a part of) a microprocessor. When the light source is not known or when the light source may be one out of a number of different light sources or when a number of light sources may vary, it might be necessary to measure a signal in the supply circuit, and the control signal may have to be derived from the measured signal.

The light source may be a High Intensity Discharge lamp or HID lamp, for example AC type, in which commutation takes place at a time when an electrode temperature is high, such as for example at or shortly after a maximal current flow.

A second aspect of the invention provides a device comprising a supply circuit according to the invention.

A third aspect of the invention provides a method of supplying a voltage signal and a current signal to a light source, the method comprising at least one switching step and a controlling step for controlling the at least one switching step for reducing a value of at least one frequency component of a harmonic content of a power spectrum of the light source.

A fourth aspect of the invention provides a control signal for controlling a supply circuit for supplying a voltage signal and a current signal to a light source, the control signal being designed for reducing a value of at least one frequency component of a harmonic content of a power spectrum of the light source.

A fifth aspect of the invention provides a medium for storing and comprising information for generating a control signal according to the invention.

This information may be direct information for generating a control signal in a relatively direct way, or this information may be indirect information that is used for converting a measured signal into a control signal in a relatively indirect way.

Embodiments of the system and the method and the control signal and the medium correspond with the embodiments of the supply circuit.

An insight might be that visible flicker in light from a light source results from the light source having a power spectrum with a harmonic content. A basic idea might be that a switch in a supply circuit is to be controlled in such a way that a value of at least one frequency component of the harmonic content of the power spectrum is reduced.

The invention solves the problem of providing a supply circuit for supplying a voltage signal and a current signal to a light source having at least reduced visible flicker (preferably non-visible flicker only), without a relatively large energy storage capacitor being required (preferably without any energy storage capacitor being required at all). The invention is further advantageous in that an energy storage capacitor can be avoided in the supply circuit.

These and other aspects of the invention are apparent from and will be elucidated with reference to the embodiments described hereinafter.

DETAILED DESCRIPTION OF EMBODIMENTS

Figure 1:
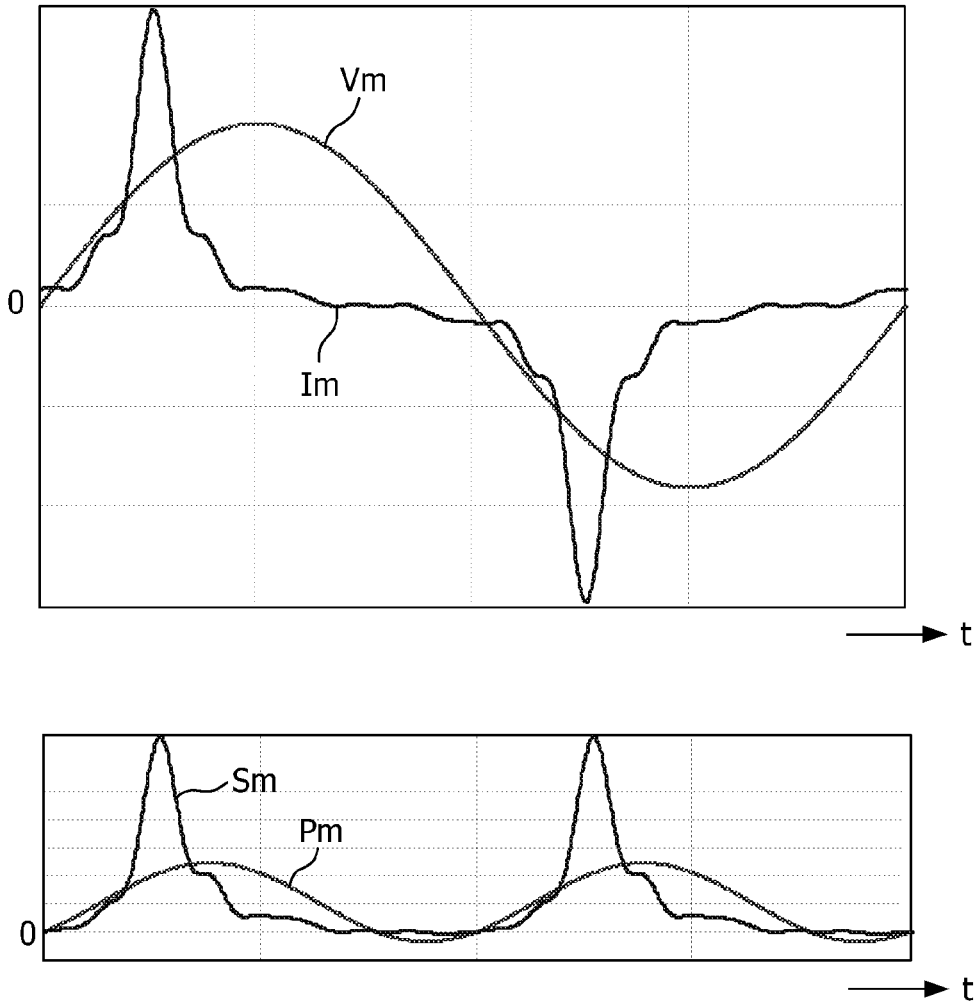
FIG. 1 shows a mains voltage and a simulated mains current (upper graph) and a mains power and a mains function (lower graph) for a lamp fed by a prior art supply circuit.

FIG. 1 shows a mains voltage Vm and a simulated mains current Im in its upper graph and a mains power Pm and a mains function Sm in its lower graph for a lamp fed by a prior art supply circuit. This current shape is typically found when an electrolytic capacitor is charged via a standard diode rectifier. The harmonic content is quite high, but this is not an issue with small lamps (for example 25 Watt) owing to the fact that there is a legislation exception for such small lamps. When applying the mains current Im without energy storage to the lamp, the light fluctuation is equal to the Sm function. To visualize the effect, this depiction in the time domain may be transferred to the frequency domain, as shown in FIG. 2.

Figure 2:
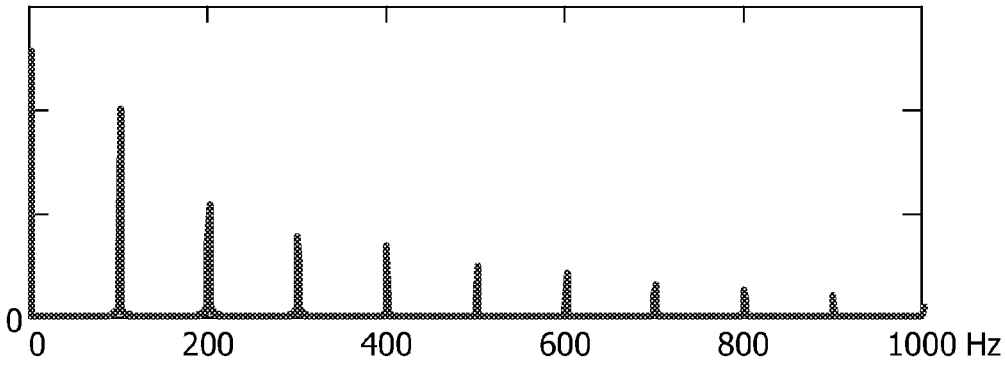
FIG. 2 shows a frequency spectrum of the power of the lamp when fed with the distorted mains current shown in FIG. 1.

FIG. 2 shows a frequency spectrum of the power of the lamp when fed with the distorted mains current shown in the FIG. 1. Apart from a DC light emission with a 26 Watt amplitude there is a significant component at 100 Hz with a 20 Watt amplitude, which is 78% of a light flux. When applying a lamp with magnetic ballast, the current and power have a substantially sinusoidal shape (thereby neglecting a non-linear behavior of the HID lamp) and the frequency spectrum is shown in FIG. 3.

Figure 3:
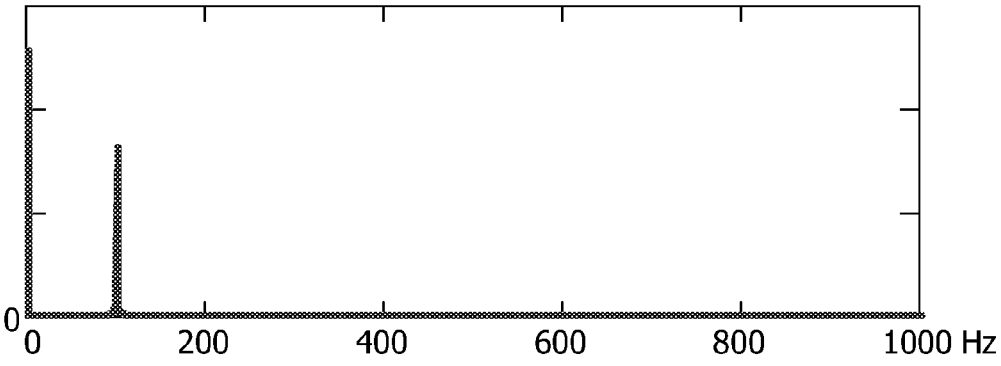
FIG. 3 shows a frequency spectrum of the power of the lamp when fed with a sinusoidal mains current.

FIG. 3 shows a frequency spectrum of the power of the lamp when fed with a sinusoidal mains current. The component at 100 Hz has an amplitude of about 16.4 Watt, which in this example is 63% of the light flux.

Figure 4:
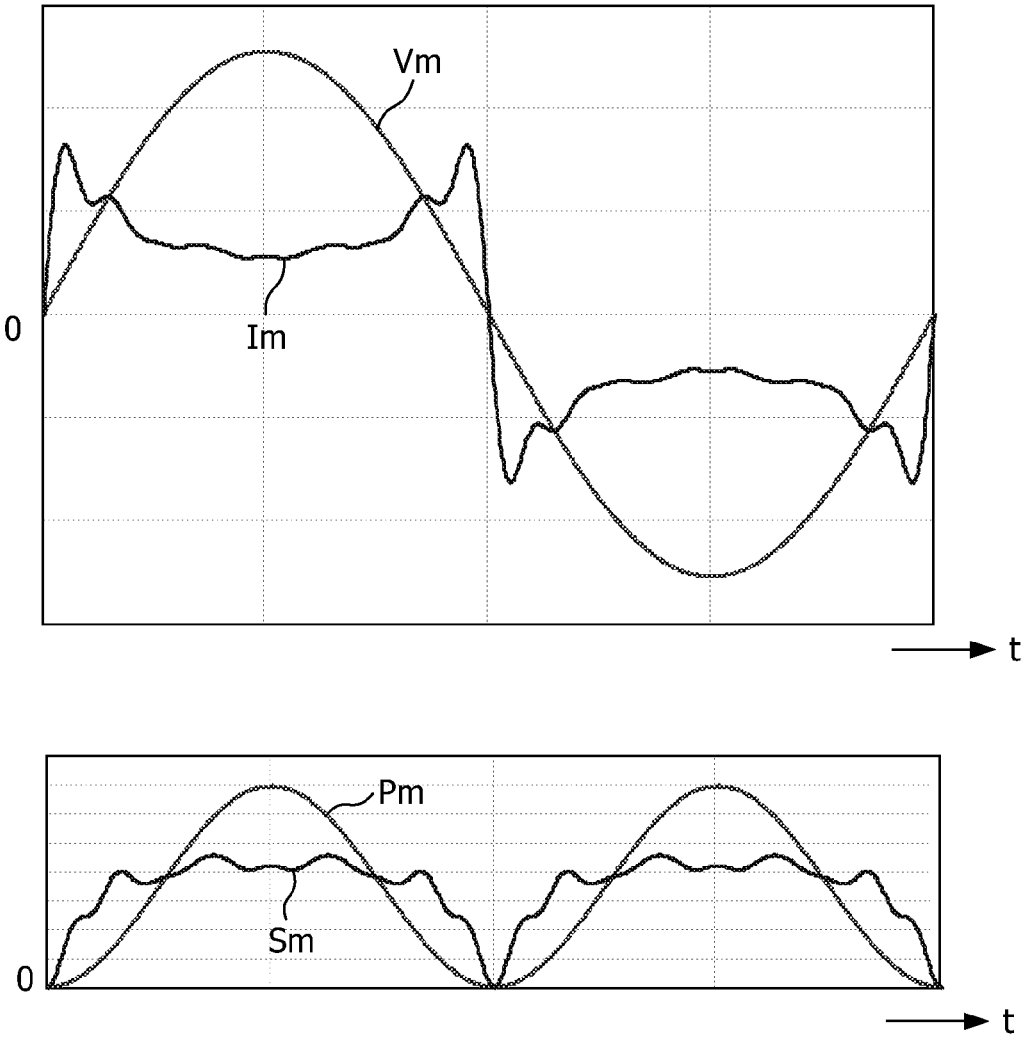
FIG. 4 shows a mains voltage and a simulated mains current (upper graph) and a mains power and a mains function (lower graph) for a lamp fed by a supply circuit, for adjusted phase angles of the frequency components of the harmonic content of the mains current.

FIG. 4 shows a mains voltage and a simulated mains current in its upper graph and a mains power and a mains function in its lower graph for a lamp fed by a supply circuit, for adjusted phase angles of the frequency components of the harmonic content of the mains current. Only the phase angles of the frequency components have been adjusted; the harmonic amplitudes of the frequency components have not been changed. Even without energy storage the lamp power flux can become close to a square wave. Peak currents are lower than in the standard situation. The frequency analysis in FIG. 5 shows how far the low frequency flicker can be reduced.

Figure 5:
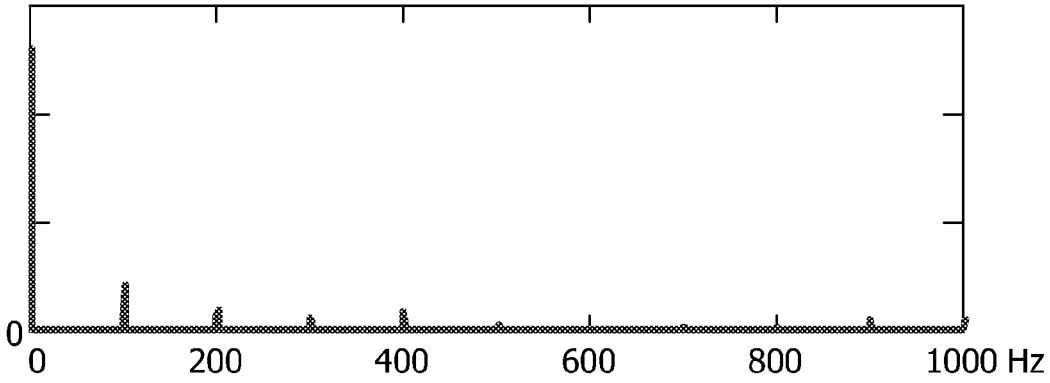
FIG. 5 shows a frequency spectrum of the power of the lamp when fed with the mains current shown in FIG. 4.

FIG. 5 shows a frequency spectrum of the power of the lamp when fed with the mains current shown in FIG. 4. The amplitude of the 100 Hz component has been reduced to 4.3 Watt, which equals only 16.5% and is practically no longer a problem. For a practical realization it is not required to reduce the higher frequency components to below that level, so the current shape can become even better when designing for 16.5% of 200 Hz and 100 Hz, as shown in FIG. 7.

Figure 6:
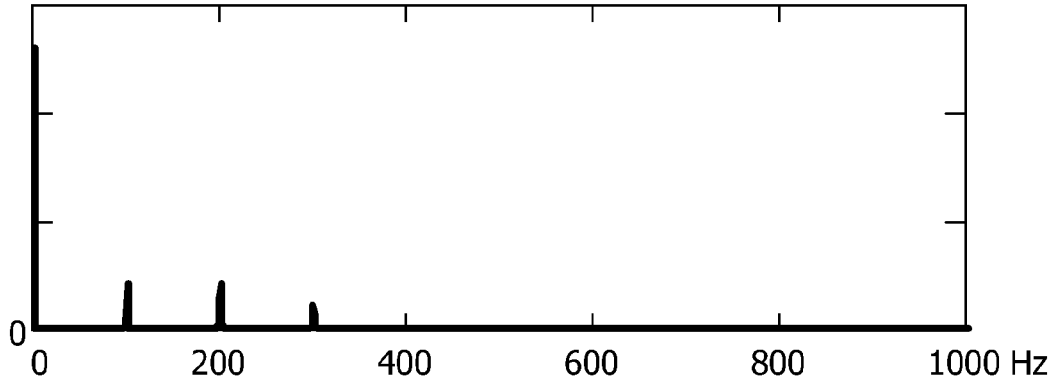
FIG. 6 shows a frequency spectrum of the power of the lamp when fed with the mains current shown in FIG. 7.
Figure 7:
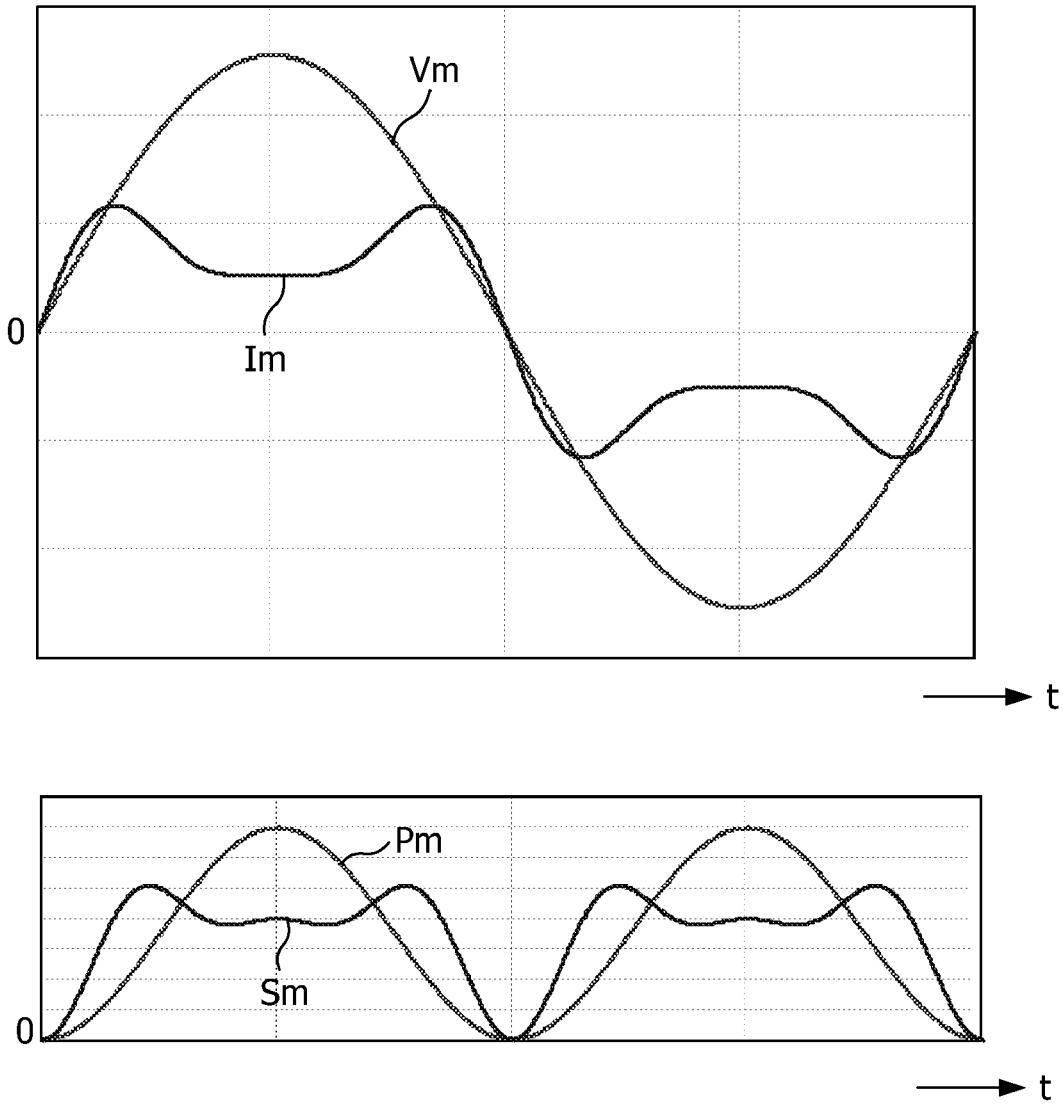
FIG. 7 shows a mains voltage and a simulated mains current (upper graph) and a mains power and a mains function (lower graph) for a lamp fed by a supply circuit, for a mains current having only third and fifth harmonic components.

FIG. 6 shows a frequency spectrum of the power of the lamp when fed with the mains current shown in FIG. 7.

FIG. 7 shows a mains voltage and a simulated mains current in its upper graph and a mains power and a mains function in its lower graph for a lamp fed by a supply circuit, for a mains current having only third and fifth harmonic components. With a higher content of the lower harmonics an even better reduction of flicker is possible, as shown in FIG. 8, but this may be outside legislation.

Figure 8:
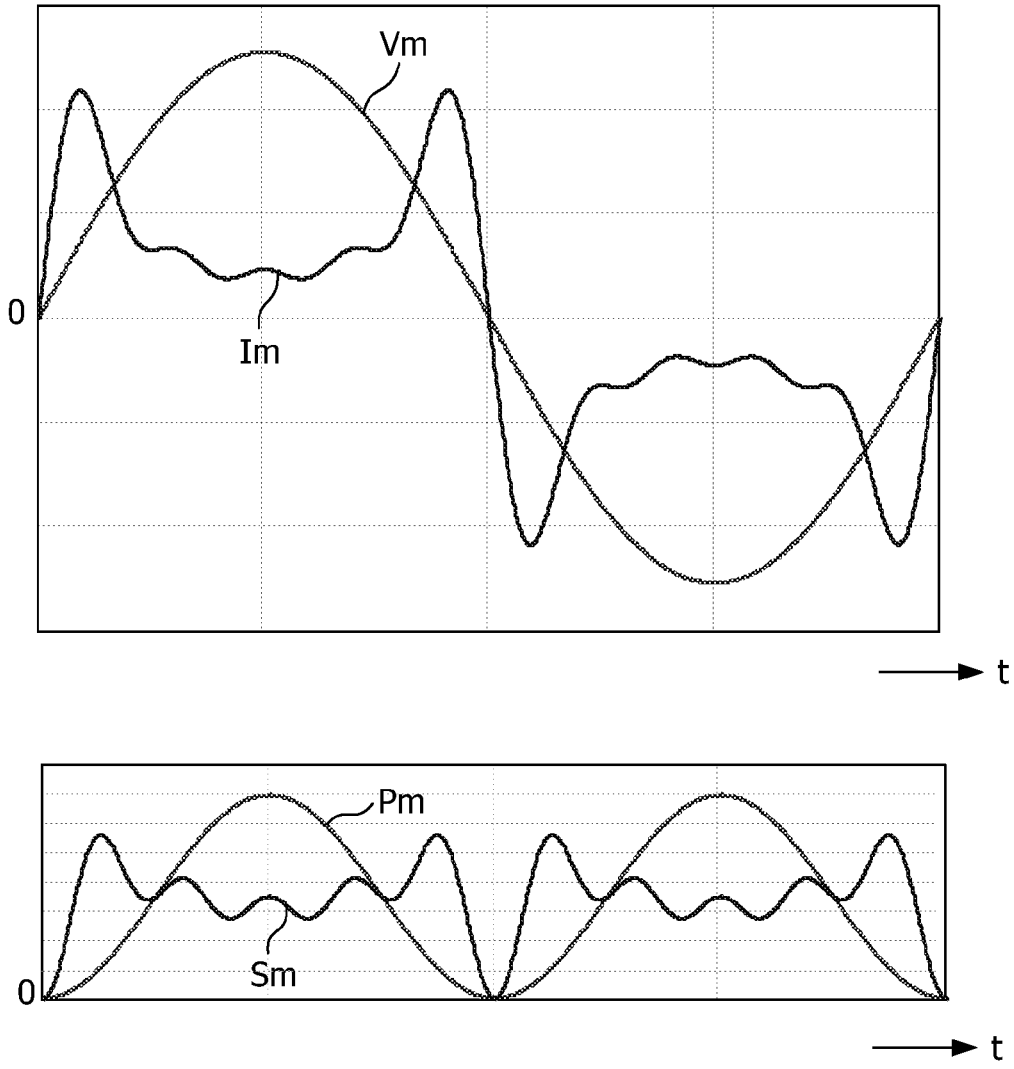
FIG. 8 shows a mains voltage and a simulated mains current (upper graph) and a mains power and a mains function (lower graph) for a lamp fed by a supply circuit, for a mains current designed such that a 100 Hz component of the mains power has been reduced to a large extent such as for example to zero.

FIG. 8 shows a mains voltage and a simulated mains current in its upper graph and a mains power and a mains function in its lower graph for a lamp fed by a supply circuit, for a mains current designed such that a 100 Hz component of the mains power has been reduced to a large extent such as for example to zero.

Figure 9:
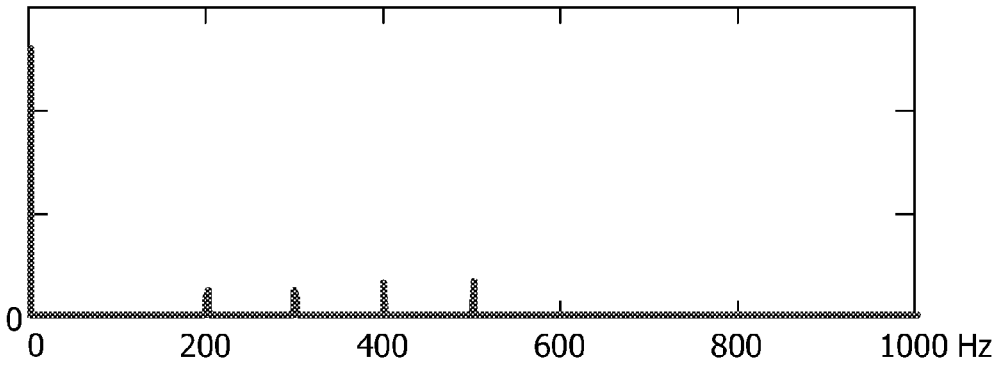
FIG. 9 shows a frequency spectrum of the power of the lamp when fed with the mains current shown in FIG. 8.

FIG. 9 shows a frequency spectrum of the power of the lamp when fed with the mains current shown in FIG. 8. Here the 100 Hz component has been completely removed, and the 200 Hz component has an amplitude of only 2.5 Watt.

Normally, lighting equipment is rated according to Class C of IEC61000-3-2. For Power levels below 25 W there are special, less strict rules. There are two options, A and B, as to how the input current is allowed to be distorted:

A. According to the power-related limits of Class D of IEC61000-3-2, for European mains, 220 Volt . . . 240 Volt, 78.2% of the third harmonic, 43.7% of the fifth, 23% of the seventh, 11.5% of the ninth, etc. As long as these limits are fulfilled there is no additional restriction.

B. According to a set of special conditions, when the wave has a certain shape, the third harmonic can reach 86% and the fifth 61%. In this case there are restrictions for the last peak in the current wave shape, which reduce the performance of the flicker reduction.

Figure 10:
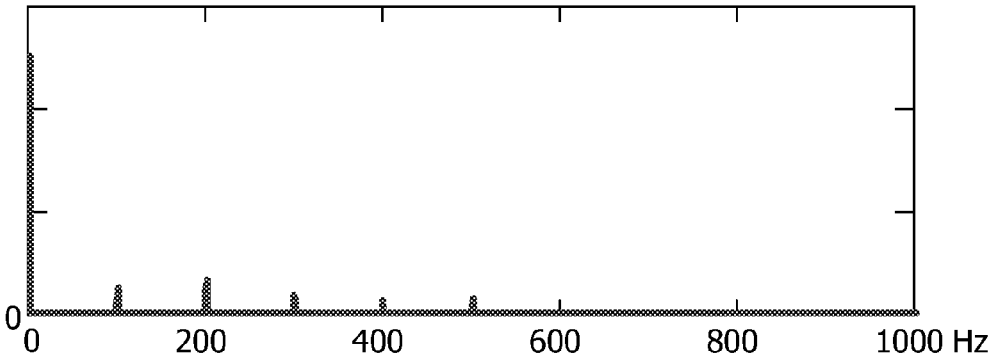
FIG. 10 shows a frequency spectrum of the power of the lamp when fed with the mains current shown in FIG. 11.
Figure 11:
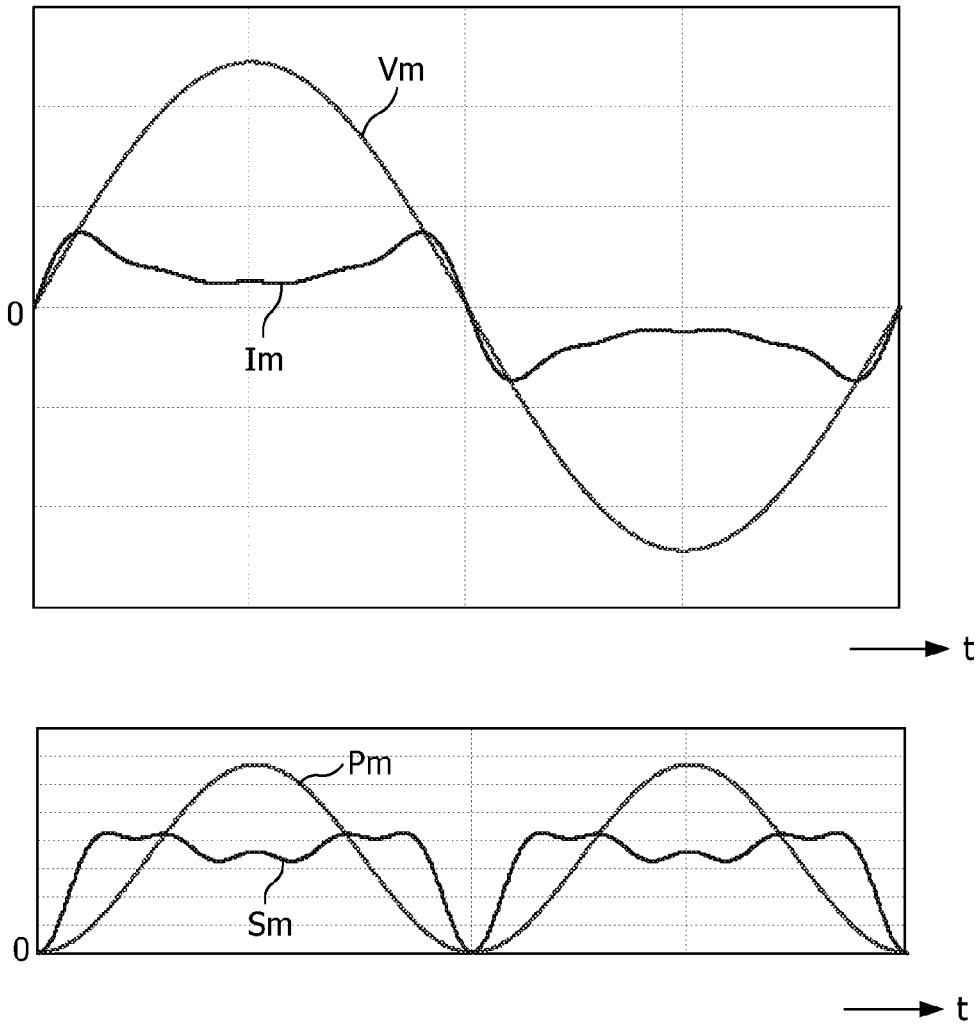
FIG. 11 shows a mains voltage and a simulated mains current (upper graph) and a mains power and a mains function (lower graph) for a lamp fed by a supply circuit, for a mains current at maximum permissible distortion.

FIG. 10 shows a frequency spectrum of the power of the lamp when fed with the mains current shown in FIG. 11. The 100 Hz flicker component now only has an amplitude of about 10% of the total power.

FIG. 11 shows a mains voltage and a simulated mains current in its upper graph and a mains power and a mains function in its lower graph for a lamp fed by a supply circuit, for a mains current at maximum permissible distortion.

A most straightforward implementation uses a standard topology consisting of a pre-conditioner and a lamp driver (e.g. a current source for LEDs). A difference may be that buffer capacitors found at an output of the pre-conditioner might be replaced by small (e.g. ceramic) ones, which only filter the high frequency content. In this implementation the current can be shaped exactly according to the required performance. Other (more advanced) implementations are possible by using a flyback or sepic converter for direct conversion of mains to LED current.

Applications may be LED lamps or lamp drivers that are free from buffer capacitors (low cost, extreme miniaturization, long lifetime).

Other applications may be HID and CFL lamps. Then, some additional requirements as to lamp behavior may need to be considered, as described hereinbelow in I, II, III and IV.

I. A main approach is to omit energy storage, which means that input power equals output power at all times. Independently from this, commutation of lamp current can be done at any time. This time is determined by what is best suited for a given lamp. For HID lamps it is best to commutate at a time where the electrode temperatures are high, that means at or shortly after a maximal current flow. This condition can easily be fulfilled.

II. The HID lamps, especially low power versions, may have some problems going to an extremely low current. This is because the electrodes (from the stage of their design) are very cold, so the conduction channel may be lost below a certain threshold. To deal with this problem, a minimal level of current can be introduced to the current wave shape. This adds a little bit of energy storage requirement to the design, but still much less than in any conventional approach.

III. Additional requirements for energy storage are sometimes given by the mains dips specification. An implementation according to II will automatically also apply this low current during the mains dip and keep the lamp alive as long as possible with the energy storage available.

IV. As light might be slightly dependent on current direction, a lamp current commutation can introduce flicker as well, and is preferred to be at a higher frequency than the mains current.

Figure 12:
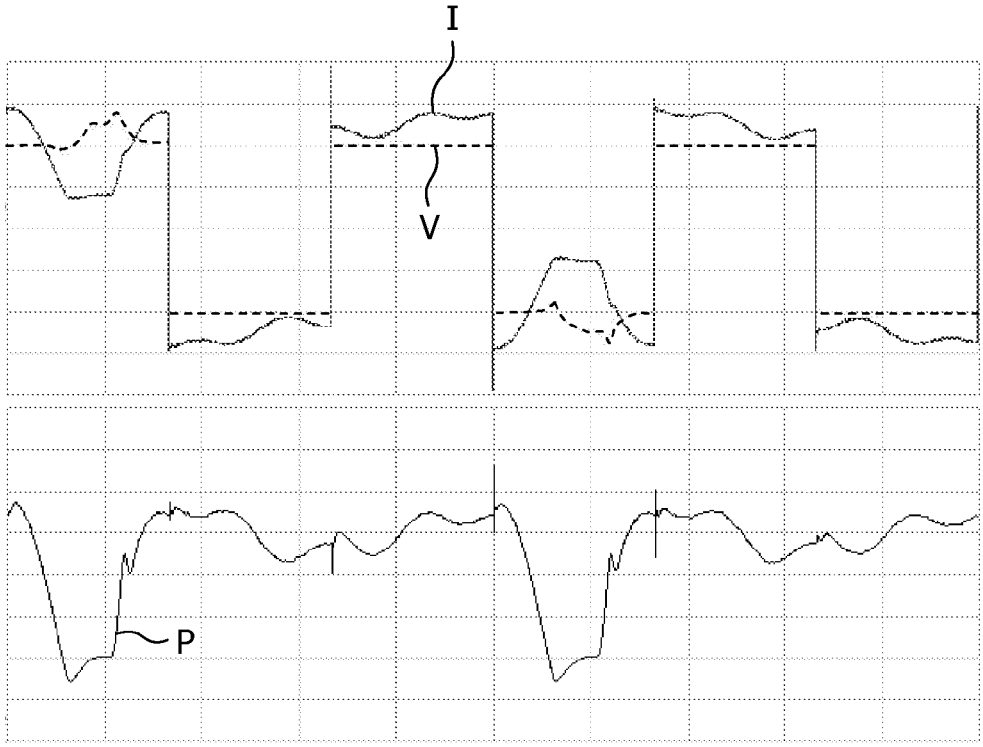
FIG. 12 shows a lamp voltage and a lamp current (upper graph) and a lamp power (lower graph) according to a relatively optimal implementation using AC driven lamps such as gas discharge lamps.

FIG. 12 shows a lamp voltage V and a lamp current I in its upper graph and a lamp power P in its lower graph according to a relatively optimal implementation using AC driven lamps such as gas discharge lamps. The lamp current is commutated with 150 Hz, which is a good operation frequency for such lamps and prevents visible flicker from burner asymmetries. The commutations are always during the highest current phases, which is good for electrodes and EMI (low re-ignition voltages). The current shape introduces a lower limit to prevent lamp extinction. The power curve shows the general form resulting from the proposed shaping of the mains current, but doesn't go to zero anymore.

Figure 13:
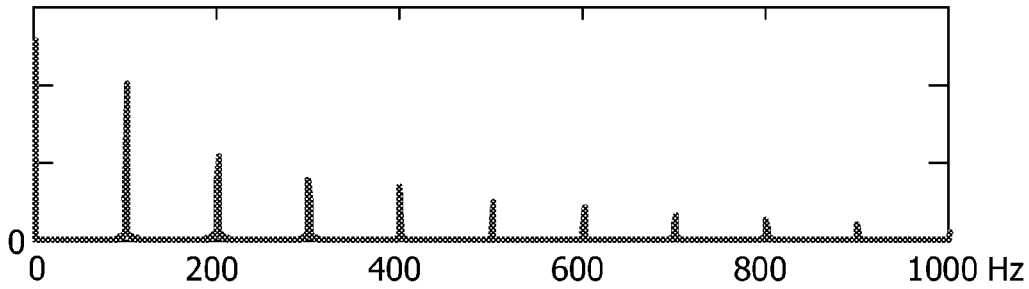
FIG. 13 shows a frequency spectrum of the power of the lamp when fed with a prior art lamp current.

FIG. 13 shows a frequency spectrum of the power of the lamp when fed with a prior art lamp current.

Figure 14:
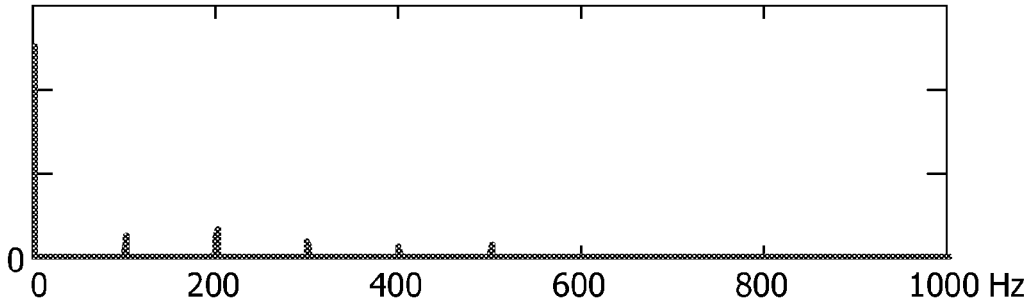
FIG. 14 shows a frequency spectrum of the power of the lamp when fed with a lamp current according to the relatively optimal implementation of FIG. 12.

FIG. 14 shows a frequency spectrum of the power of the lamp when fed with a lamp current according to the relatively optimal implementation of FIG. 12.

By means of current synthesis in the frequency domain it becomes possible to remove or strongly reduce the required filter capacitances in electronic lamps (for example below 25 Watt power level). Exploiting the limits of acceptable harmonic content in the mains current allows removing any visible flicker effect. Reliability and lifetime of the products can be significantly improved. Higher operation temperatures enable further miniaturization and cost savings. Exploitation of full LED lifetimes at high operation temperatures has become possible.

Figure 15:
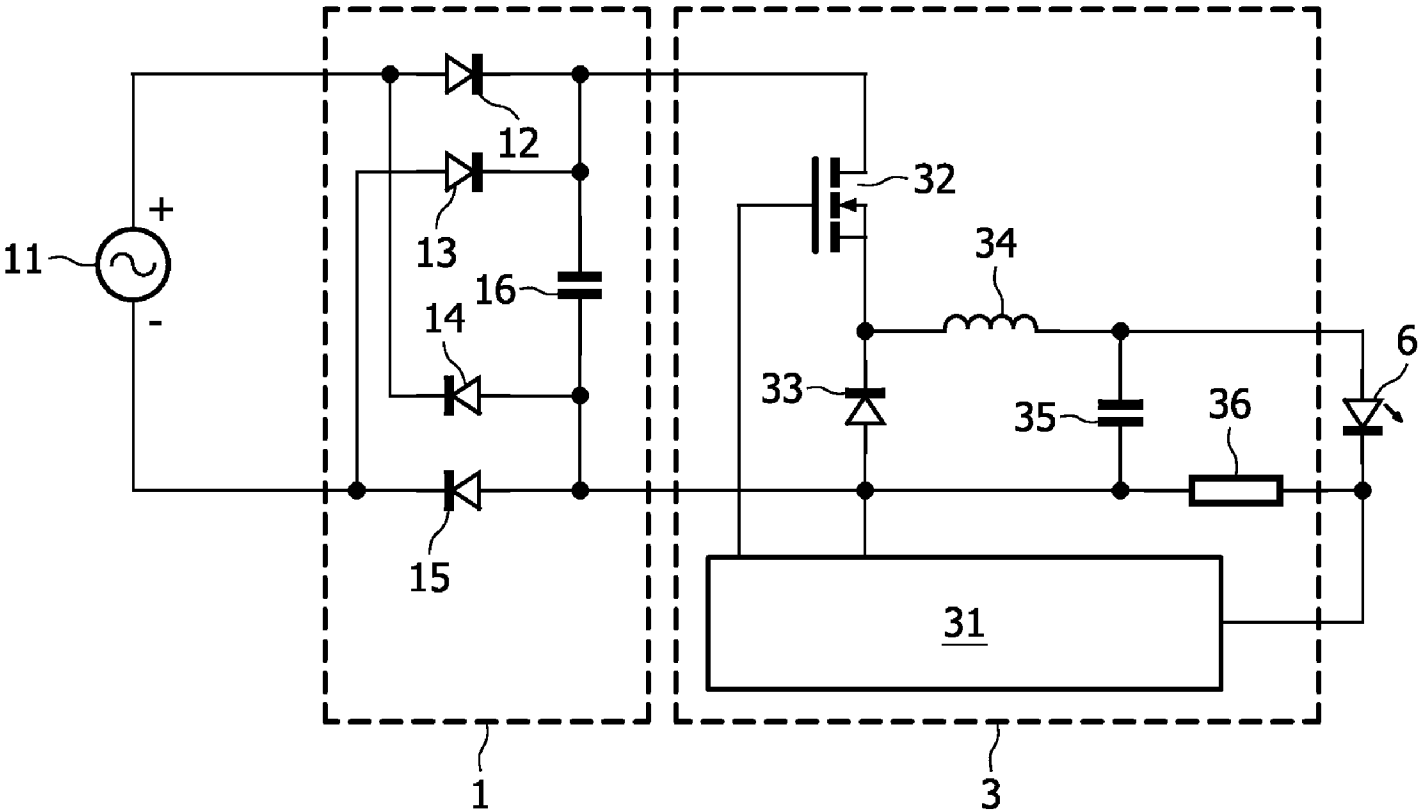
FIG. 15 shows a prior art supply circuit comprising a rectifier and a buck converter.

FIG. 15 shows a prior art supply circuit comprising a rectifier 1 and a buck converter 3. The rectifier 1 comprises a rectifier bridge consisting of four diodes 12-15. Inputs of the bridge are coupled to an AC source 11 (for example for generating 230 Volt) and outputs of the bridge are coupled to an electrolytic capacitor 16 having a value of for example 10 μF, 350 Volt for reducing flicker. The buck converter 3 comprises a serial circuit 32-33 of a transistor 32 and an anti-serial diode 33. This serial circuit 32-33 is coupled in parallel to the electrolytic capacitor 16. Parallel to the diode 33, another serial circuit 34-35 of an inductor 34 and a capacitor 35 is present. Parallel to the capacitor 35, a yet other serial circuit of a resistor 36 and a light source 6 such as a LED is present. A control electrode of the transistor 32, a common point of the diode 33 and the resistor 36 and a common point of the resistor 36 and the light source 6 are coupled to a LED controller 31.

Figure 16:
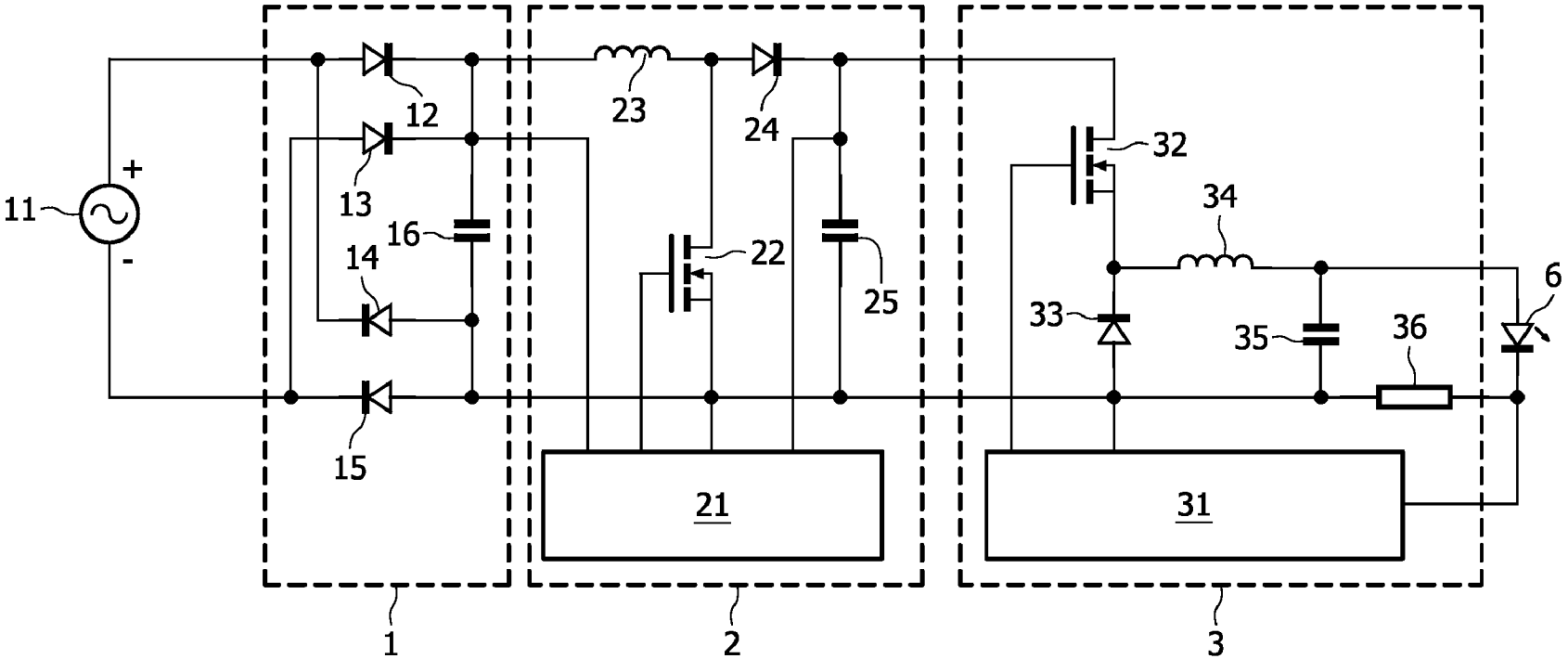
FIG. 16 shows a prior art supply circuit comprising a rectifier and a boost converter and a buck converter.

FIG. 16 shows a prior art supply circuit comprising a rectifier 1 and a boost converter 2 and a buck converter 3. The rectifier 1 and the buck converter 3 have already been discussed for FIG. 15. The boost converter 2 is located between and coupled in parallel to the outputs of rectifier 1 and the inputs of the buck converter 3 and comprises a serial circuit 23-22 of an inductor 23 and a transistor 22 coupled to the outputs of the rectifier 1 and further comprises another serial circuit 24-25 of a diode 24 and a capacitor 25 coupled to the serial circuit 23-22 and to the inputs of the buck converter 3. A control electrode of the transistor 22, a common point of the diode 24 and the capacitor 25 and the outputs of the rectifier are coupled to a power factor corrector controller 21. The boost converter 2 allows the capacitor 16 to become smaller and non-electrolytic, but the capacitor 25 must have a value of for example 10 μF, 400 Volt for reducing flicker. The supply circuit of FIG. 16 is used for cases with higher power and/or stricter regulations.

To realize the invention, according to a first option, the power factor corrector controller 21 and the LED controller 31 must further be coupled to each other for synchronization purposes and to create mains voltages and mains currents as shown in FIGS. 4, 7, 8 and/or 11. Then, even the capacitor 25 can become smaller and non-electrolytic.

Figure 17:
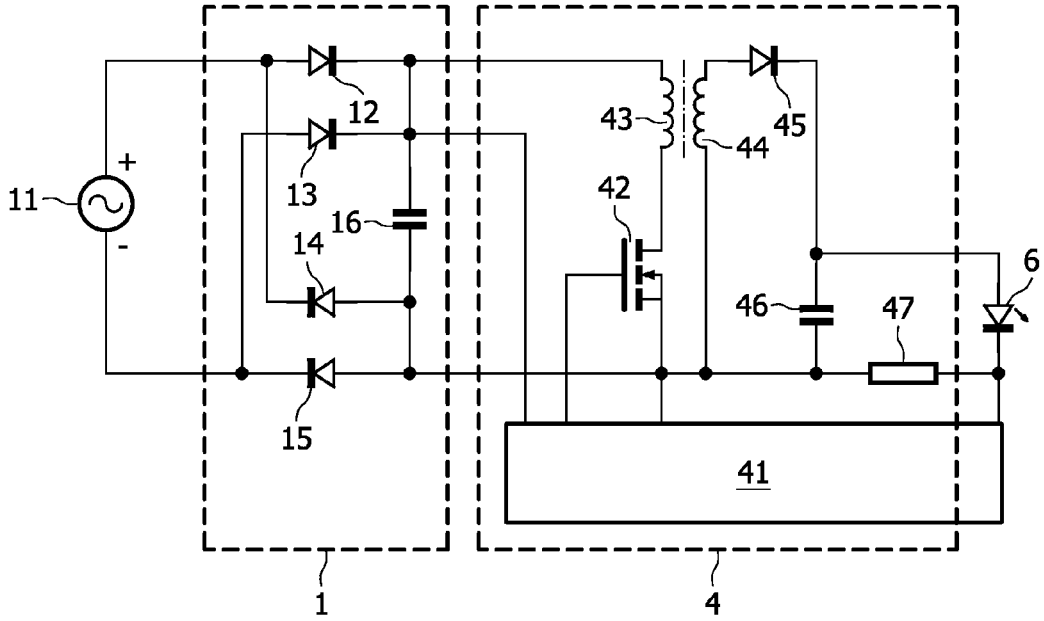
FIG. 17 shows a supply circuit according to the invention comprising a rectifier and a fly back or sepic converter.

FIG. 17 shows a supply circuit according to the invention comprising a rectifier 1 and a fly back or sepic converter 4. This is a second option for realizing the invention. The rectifier 1 has already been discussed for FIG. 15. The fly back or sepic converter 4 comprises a serial circuit of a primary winding 43 of a transformer and a transistor 42 coupled in parallel to the outputs of the rectifier 1. A secondary winding 44 of the transformer is coupled in parallel to another serial circuit of a diode 45 and a capacitor 46. Parallel to the capacitor 46, a yet other serial circuit of a resistor 47 and a light source 6 such as a LED is present. A control electrode of the transistor 42, a common point of the capacitor 46 and the resistor 47 and a common point of the resistor 47 and the light source 6 are coupled to a LED and power factor controller 41. A difference between a fly back converter and a sepic converter is that the sepic converter comprises an additional capacitor (not shown) between the windings.

Figure 18:
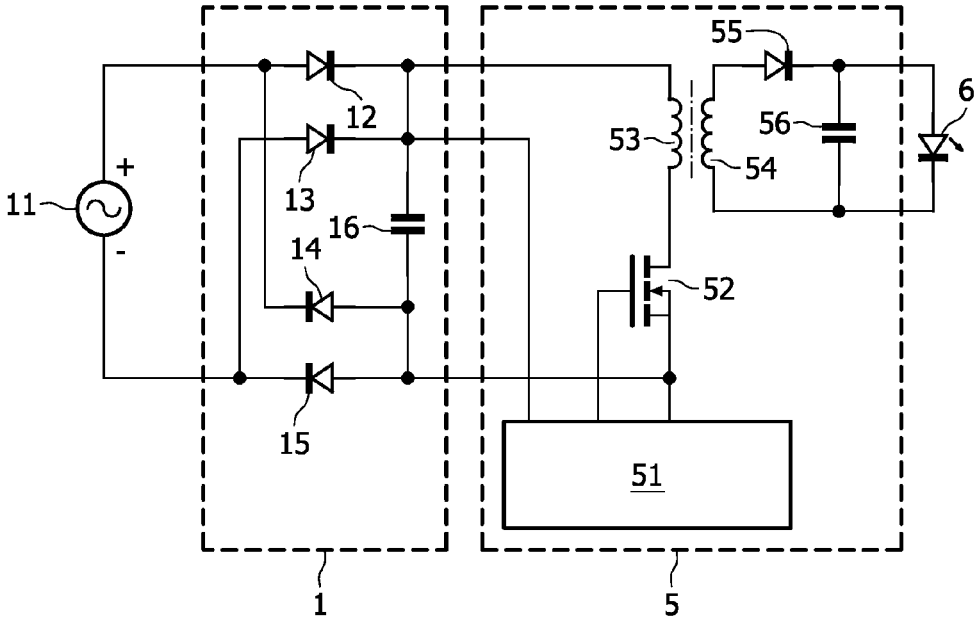
FIG. 18 shows a supply circuit according to the invention comprising a rectifier and a fly back converter.

FIG. 18 shows a supply circuit according to the invention comprising a rectifier 1 and a fly back converter 5. This is a third option for realizing the invention, without excluding further options. The rectifier 1 has already been discussed for FIG. 15. The fly back converter 5 comprises a serial circuit of a primary winding 53 of a transformer and a transistor 52 coupled in parallel to the outputs of the rectifier 1. A secondary winding 54 of the transformer is coupled in parallel to another serial circuit of a diode 55 and a capacitor 56. Parallel to the capacitor 56, a light source 6 such as a LED is present. A control electrode of the transistor 52, and a common point of the transistor 52 and an output of the rectifier 1 are coupled to a LED and power factor controller 51.

By controlling the on- and off-switching of the transistors 42 and 52 in FIGS. 17 and 18, the input current and the amplitude of the average output current can be controlled. In case of the light source having relatively small parameter variations, a measurement of the output current is not necessary and galvanic isolation as shown in the FIG. 18 is possible. In case of the light source having relatively unknown parameter variations, the current through the primary winding or through the transistor can be measured by for example the controller or a measurement result can be supplied to the controller.

The controller may comprise an arrangement (a memory) for generating a control signal for the transistor (the switch) or may comprise a converter for converting a measured signal (for example a measured current) into a control signal for the transistor (the switch). In other words, information may be stored that is used for generating the control signal (either directly, or indirectly by converting a measured signal). This information may be stored in a table, possibly in a scaled way, and may be used for generating, if possible, in a synchronized way the control signal with the input voltage.

A voltage may be defined as:

$$V(t)=\sqrt{2}V_{rms}\sin(2\pi ft)$$

A current may be defined for a resistive load as:

$$I(t)=\sqrt{2}I_{rms}\sin(2\pi ft)$$

For an inductive or capacitive load a phase angle may be introduced:

$$I(t)=\sqrt{2}I_{rms}\sin(2\pi ft+\phi)$$

A distorted current consists of several frequency components:

$$I_n(t)=\sqrt{2}I_{rms,n}\sin(2\pi nft+\phi_n)=\sqrt{2}\cdot I_{rms}\cdot i_n\cdot\sin(2\cdot\pi\cdot n\cdot f\cdot t+\phi_n)$$

The total current may then be defined as:

$$I(t)=\sum_n I_n(t)=\sqrt{2}\cdot I_{rms}\sum_n i_n\cdot\sin(2\cdot\pi\cdot n\cdot f\cdot t+\varphi_n)$$

A suitable definition of the current for FIGS. 1 and 2 is obtained by taking the odd components and phase angles between 0 and π. Optimal flicker reduction is obtained when all phase angles are 0. The amplitudes can then be optimized in accordance with further conditions. In most cases these amplitudes may reach a permitted maximum value, owing to the fact that in that case a maximum flicker reduction is realized too.

The values I(t) may be calculated half a period (i.e. 128 time discrete points) in advance and may be temporarily stored in a memory. A microprocessor detects a zero crossing in the input voltage and starts reading out a first value of I(t)=I(0). Then (for 128 points and 50 Hz) every 78.125 μs new current values are loaded.

In a simple embodiment the current values are converted into voltages via a digital to analog converter. The transistor operating as a switch is activated (is switched on and/or is made conductive) via discrete logic circuitry when the current has just crossed a zero value. Then the transistor is deactivated (is switched off and/or is made non-conductive) when the current has reached twice the value calculated and stored. Owing to the fact that the rise and fall of the current will be substantially linear, the average value will be equal to the value calculated and stored.

The switch may be any kind of transistor or may be another kind of switch, such as for example a thyristor, a triac or a relay, without excluding further switches.

Summarizing, supply circuits for supplying voltage and current signals to light sources 6 comprise switches 22, 32, 42, 52 and controllers 21, 31, 41, 51 to control the switches 22, 32, 42, 52 for reducing values of frequency components of harmonic content of power spectra of the light sources 6. By switching one of the voltage and current signals or by switching signals that result in one of the voltage and current signals, the other one of the voltage and current signals can be adjusted. The power spectrum of the light source 6 may be a function of the voltage and current signals. By adjusting one of them, the power spectrum can be adjusted such that values of frequency components of the harmonic content of the power spectrum are reduced. As a result, visible flicker is reduced in the light originating from the light source 6, without the use of energy storage capacitors for reducing this visible flicker.

While the invention has been illustrated and described in detail in the drawings and foregoing description, said illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A supply circuit for supplying a voltage signal and a current signal to a light source, the supply circuit comprising at least one switch and a controller to control the at least one switch for reducing a value of at least one frequency component of a harmonic content of a power spectrum of the light source, the at least one frequency component of the harmonic content comprising at least a first frequency component at a frequency equal to twice a basis frequency of at least one of a further voltage signal and a further current signal originating from an AC source, the supply circuit reducing visible flicker in the light originating from the light source without using an electrolytic or energy storage capacitor for reducing this visible flicker.

2. A supply circuit as claimed in claim 1, wherein the power spectrum is a function of the voltage signal and the current signal, and wherein the at least one switch switches the voltage signal for controlling the current signal.

3. A supply circuit as claimed in claim 1, wherein the controller comprises an arrangement for generating a control signal for the at least one switch.

4. A supply circuit as claimed in claim 1, wherein the controller comprises a converter for converting a measured signal into a control signal for the at least one switch.

* * * * *